US007156624B2

(12) United States Patent
Shoulders

(10) Patent No.: US 7,156,624 B2
(45) Date of Patent: Jan. 2, 2007

(54) COMPRESSOR SOUND SUPPRESSION

(75) Inventor: Stephen L. Shoulders, Baldwinsville, NY (US)

(73) Assignee: Carrier Corporation, Syracuse, NY (US)

( * ) Notice: Subject to any disclaimer, the term of this patent is extended or adjusted under 35 U.S.C. 154(b) by 179 days.

(21) Appl. No.: 11/008,850

(22) Filed: Dec. 9, 2004

(65) Prior Publication Data

US 2006/0127235 A1 Jun. 15, 2006

(51) Int. Cl.
*F04B 39/00* (2006.01)
*B23P 6/00* (2006.01)
*F04B 49/00* (2006.01)

(52) U.S. Cl. ..... 417/312; 181/212; 29/888.021; 29/888.023

(58) Field of Classification Search ..... 417/312, 417/213, 540; 181/212; 29/888.021, 888.02, 29/888.023
See application file for complete search history.

(56) References Cited

U.S. PATENT DOCUMENTS 3,890,461 A * 6/1975 Vogelman et al. ..... 380/228
3,913,346 A * 10/1975 Moody et al. ..... 62/197
4,573,324 A * 3/1986 Tischer et al. ..... 62/115

* cited by examiner

*Primary Examiner*—Charles G. Freay
(74) *Attorney, Agent, or Firm*—Bachman & LaPointe, P.C.

(57) ABSTRACT

A compressor has a housing. One or more working elements cooperate with the housing to define a compression path between suction and discharge locations. An intermediate port is located along the compression path. A branch path extends to the intermediate port. The compressor includes means for limiting pressure pulsations along the branch path.

20 Claims, 3 Drawing Sheets

COMPRESSOR SOUND SUPPRESSION

BACKGROUND OF THE INVENTION

The invention relates to compressors. More particularly, the invention relates to compressors having economizer ports.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

As the refrigerant is compressed along a compression path between the inlet and outlet ports, sealing between the rotors and housing is desirable for efficient operation. To increase the mass flow in a screw compressor an economizer is used. Typical economizer ports are located along the rotor length, positioned to become exposed to the compression pockets just after such pockets are shut off from the associated suction ports. At this location the refrigerant gas trapped within the rotors is near suction pressure. Connecting gas at a pressure above suction to the economizer ports allows for a quantity of gas to flow into the compressor. Furthermore, the feeding of gas into the rotors after suction is cut off increases the pressure of the trapped gas in the rotors. This reduces the amount of work required by the compressor. Also the economizer flow is above suction pressure, so the power for a given total refrigerant mass flow is reduced.

Other forms of compressor (e.g., scroll and reciprocating compressors) may include similar economizer ports.

Nevertheless, there remains room for improvement in the art.

SUMMARY OF THE INVENTION

One aspect of the invention involves a compressor having a housing. One or more working elements cooperate with the housing to define a compression path between suction and discharge locations. An intermediate port (e.g., an economizer port for receiving an economizer flow) is located along the compression path. A branch path (e.g., an economizer path) extends to (or from, depending upon viewpoint) the intermediate port. The compressor includes means for limiting pressure pulsations along the branch path.

In various implementations, the means may be means for limiting external sound radiated by the housing due to resonating of discharge pulsation from the one or more working elements. Within a wall of the housing, the branch path may include first, second, and third legs. The first leg may extend from the intermediate port. The second leg may be distally of the first leg and essentially transverse thereto. The third leg may be distally of the second leg and essentially transverse thereto. The means may include a first blind volume extending from a junction between the second leg and one of the first and third legs. The means may further include a second blind volume extending from a junction between the second leg and the other of the first and third legs. One or both blind volumes may comprise a restriction forming a Helmholtz resonator. The means may be formed within a wall of a casting of the housing.

The compressor may be manufactured by a process including casting a precursor of a first portion of the housing. At least one bore may be machined into the precursor to accommodate the at least one working element (e.g., finish machining after a rough bore casting). The precursor may be machined to define portions of the branch path including machining first and second volumes. The first volume may be machined outward from the at least one bore. The second volume may be machined from a longitudinal end of the precursor and intersecting the first volume (either before or after the machining of the first volume). A plug may be inserted into the second volume to provide a desired tuning. A second housing portion may be secured over the longitudinal end across a proximal end of the second volume. The plug may be subflush to the first end and may have an aperture defining a port to a Helmholz resonator.

The compressor may be remanufactured from a baseline compressor or its configuration may be reengineered from a baseline configuration. An initial such compressor or configuration is provided. Such compressor/configuration includes a housing, one or more working elements, an intermediate port, and a branch path to the intermediate port. In the remanufacturing or reengineering, a blind volume is placed along the branch path. At least one geometric parameter of the blind volume is selected to provide a desired control of a pressure pulsation parameter.

In various implementations, the placing may locate the blind volume in a wall of the housing. The selecting may include an iterative process of varying the at least one geometric parameter and directly or indirectly determining the pressure pulsation parameter (e.g., until a minimum or a desired threshold has been met). The determining may include measuring a sound intensity at a target frequency for pulsation. The placing may include inserting a plug into a compartment in the housing. The plug may have an aperture defining a Helmholz resonator port. The plug may reduce an effective volume of a portion of the compartment. The placing may include extending a blind terminal portion of a compartment in the housing.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
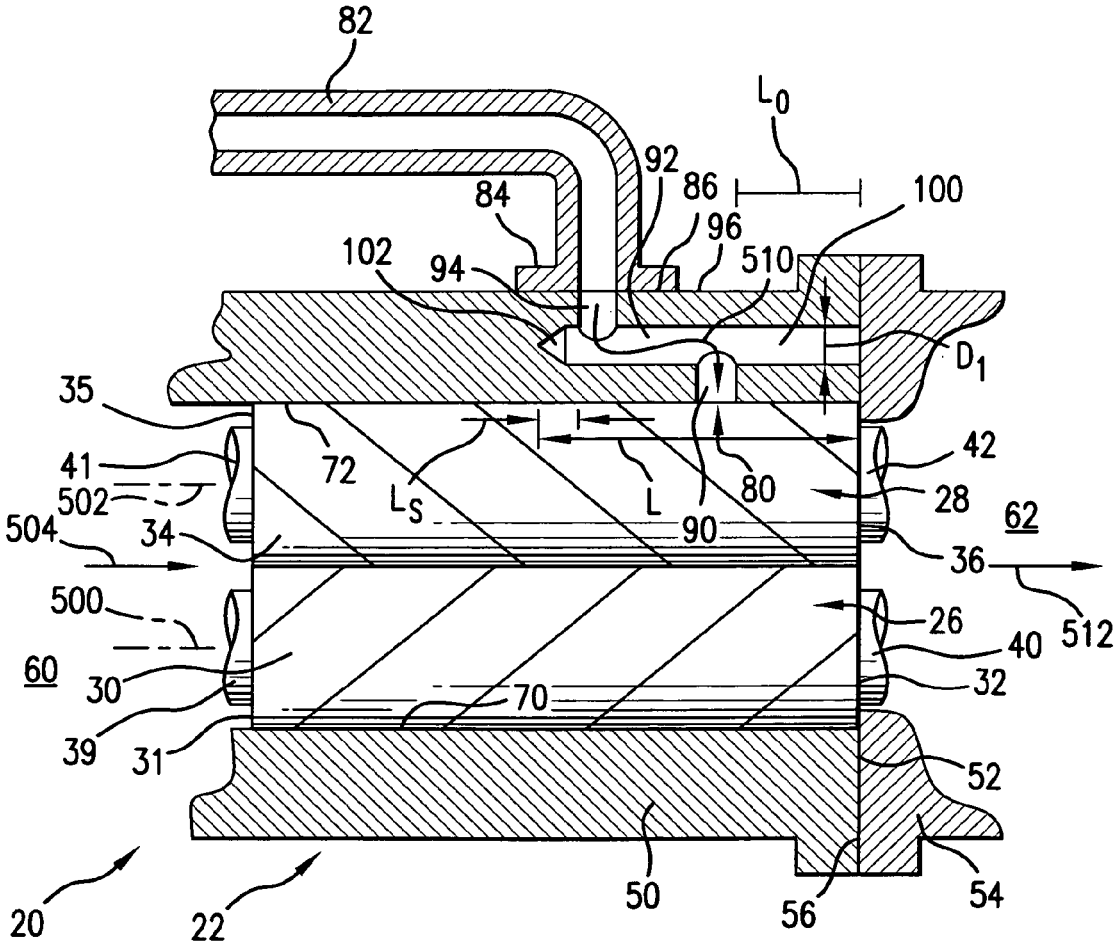
FIG.1 PRIOR ART
FIG. 1 is a partial longitudinal sectional view of a baseline compressor.

FIG. 1 shows a compressor 20 having a housing assembly 22 containing a motor (not shown) driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies (not shown) for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 50 having a discharge end face 52 essentially coplanar with the rotor body ends 32 and 36. The assembly 22 further includes an outlet housing 54 having an upstream face 56 mounted to the rotor housing downstream face (e.g., by bolts through flanges of both housing pieces). The exemplary rotor housing 50 and outlet housing 54 may each be formed as castings subject to further finish machining.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62. A pair of male and female compression pockets is formed by the housing assembly 22, male rotor body 30, and female rotor body 34. In the pair, one such pocket is located between a pair of adjacent lobes of each associated rotor.

The rotor housing interior surface includes circular cylindrical portions 70 and 72 in close facing/sealing relationship with the apexes of the lobes of the respective working portions 30 and 34. The portions 70 and 72 meet at a pair of opposed mesh zones (not shown). The housing assembly interior surface further includes portions cooperating to define the suction and discharge ports. A variety of port configurations are possible. Depending on the implementation, the ports may be radial, axial, or a hybrid of the two.

The compressor further includes an economizer port 80 (in one or both of the surfaces 70 and 72) positioned at an intermediate stage of the compression process (e.g., the first half of the process such that the economizer port is exposed to the compression pocket(s) only after the start of the compression has occurred and is closed off from such pocket(s) before ½ of the compression has occurred). The economizer port 80 may admit an economizer flow 510 of refrigerant joining with the main flow 504 along the compression path and being discharged into the discharge plenum 62 as a combined flow 512.

The economizer flow may be directed from an economizer heat exchanger or flash tank (not shown) through an economizer line 82 having a flange 84 for mounting to the housing assembly. In the exemplary embodiment, the flange 84 is mounted to a corresponding mounting area on the rotor housing 50 so that the economizer flowpath passes through the rotor housing 50. Within the rotor housing 50, the exemplary economizer flowpath includes a proximal leg 90 extending outward from the port 80. An intermediate leg 92 extends generally longitudinally transverse to the proximal leg 90. A distal leg 94 extends generally outward to the rotor housing exterior 96 at the mating feature 86.

A variety of techniques may be used to form the legs of the economizer flowpath within the housing. This may involve one or both of casting (e.g., investment casting) and machining. For example, in one implementation, gross features of the rotor housing are cast. Surfaces (e.g., 52, 70, and 72) may then be finish machined. A bore may be formed through the surface 52 creating the second leg 92 as an intermediate bore portion as well as creating a proximal bore portion 100 and a terminal bore portion 102. The proximal bore portion is toward the discharge end of the proximal leg 90 and the terminal bore portion 102 is toward the suction side of the distal leg 94. With the open proximal end of the bore at the surface 52 sealed by the outlet housing 54, the portions 100 and 102 play no net role in the economizer flowpath. The proximal and distal legs 90 and 94 may be machined from the interior and exterior of the rotor housing to complete the economizer flowpath section therethrough. In the exemplary embodiment, the proximal leg 90 may be elongate along the compression pocket (e.g., parallel to the rotor lobes) to provide enhanced flow. The distal portion 94 may be circular or otherwise sectioned to interface with the conduit 82. In the exemplary embodiment, the bore has an overall length L. The proximal portion 100 has a length $L_O$ and the terminal portion 102 has a length $L_S$. The exemplary bore is circular having a diameter $D_1$. $L_S$ will typically be fairly small as a manufacturing artifact. $L_O$ will be dictated by the particular economizer port location along the compression path. This location will depend on the designed operating parameters of the compressor. In various manufacturing techniques, the port 80 (and proximal leg 90) may have different locations for each of several versions of a basic compressor whereas the distal leg 94 and the mounting feature 86 remain unchanged to permit an economy of scale.

The opening and closing of the compression pockets at suction, discharge, and economizer ports produce pressure pulsations. As the pulsations propagate into the gas in the economizer line, they cause vibration and associated radiated sound which are undesirable. This pulsation may be at least partially addressed by modifications involving the economizer flowpath. Exemplary modifications involve modifications adjacent the economizer flowpath within the housing. Exemplary modifications make use of existing manufacturing techniques and their artifacts. Exemplary modifications may be made in a remanufacturing of an existing compressor or a reengineering of an existing compressor configuration.

Figure 2:
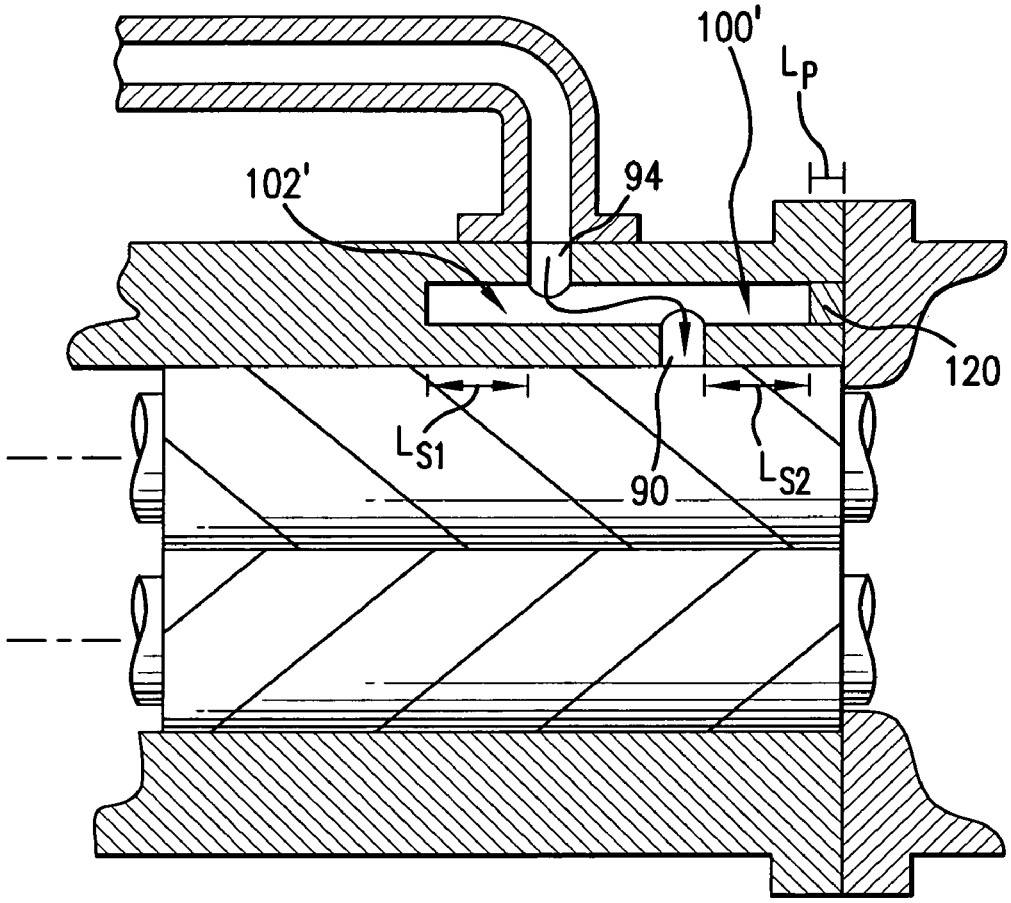
FIG. 2 is a partial longitudinal sectional view of the compressor of FIG. 1 with a first modification according to principles of the invention.

FIG. 2 shows two exemplary modifications of the basic compressor 20 of FIG. 1. One modification involves the bore terminal portion 102' to form a side branch resonator. The volume of this portion (e.g., measured distally of the junction with the distal leg 94) has been increased relative to the volume of the terminal portion 102. This increase may be achieved by an exemplary longitudinal extension (e.g., a deepening to a length $L_{S1}$). Geometric properties of the terminal portion 102' (e.g., the length and volume) may be tuned to attenuate pressure pulsations at one or more frequencies. An exemplary frequency is that of the economizer port opening/closing at the designed compressor operating speed (which may be dictated by system operating condition).

The second modification (which may be independently implemented) applies similar principles to configure the proximal volume as a side branch resonator. An exemplary plug 120 (e.g., a circular cylindrical plug) is inserted (e.g., press-fit) through the bore opening to reside in a downstream end of the bore. The plug reduces the length and volume of the net proximal portion 100' relative to that of the proximal portion 100 (the length believed to be the more relevant parameter). An exemplary plug length is shown as $L_P$, reducing the net proximal portion length to $L_{S2}$. The length of a flush plug 120 may be chosen to provide a desired tuning (e.g., as described above). Alternatively, such tuning may be achieved by the depth of insertion (e.g., beyond flush) of a given size of plug. If appropriate tuning required lengthening of the proximal volume this could be achieved by complementary boring into the mating housing 54 instead of plugging. Alternatively, if appropriate tuning required enlargement of the proximal volume this could be achieved by counterboring instead of plugging.

Figure 3:
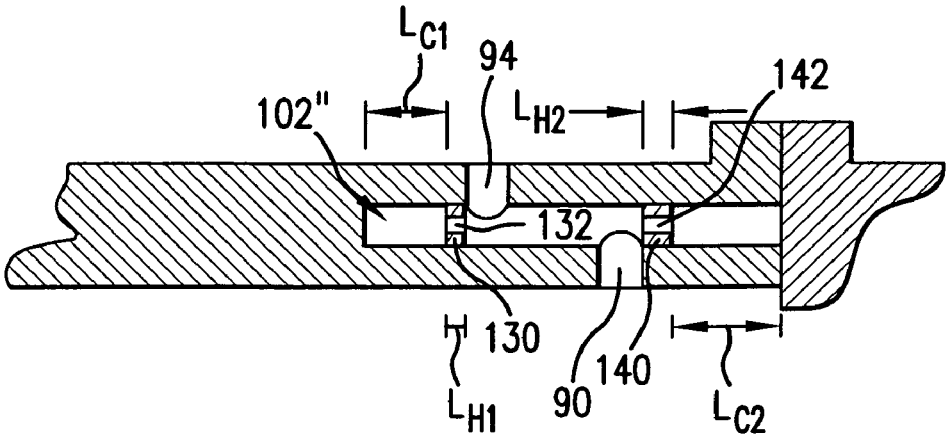
FIG. 3 is a partial longitudinal sectional view of the compressor of FIG. 1 with a second modification according to principles of the invention.

FIG. 3 shows two further modifications wherein the terminal and proximal bore portions are used to create the chambers of Helmholtz resonators. As with the first modification of FIG. 2, the bore may be deepened to create a terminal portion 102". A centrally apertured plug 130 having an aperture 132 may be inserted into the terminal portion 102" near the junction with the distal leg 94. The remaining volume of the terminal portion 102' has a length shown as $L_{C1}$ and defines the chamber of a Helmholtz resonator having an associated resonator volume. The aperture 132 has a given cross-sectional area and a length $L_{H1}$ and defines the port to the Helmholtz resonator. Exemplary apertures are circular cylinders with cross-sectional areas of 5–50% that of the bore. Chamber and aperture geometric parameters may be tuned to provide a desired sound attenuation (e.g., as described above). The more relevant Helmholtz resonator properties are believed to be the aperture/port length and cross-sectional area and the chamber volume. Similarly, a plug 140 having an aperture 142 may be inserted in the bore proximal portion near the junction with the proximal leg 90. The plug 140 has a length shown as $L_{H2}$ and leaves a resonator chamber with a length shown as $L_{C2}$ and having an associated chamber volume.

Figure 4:
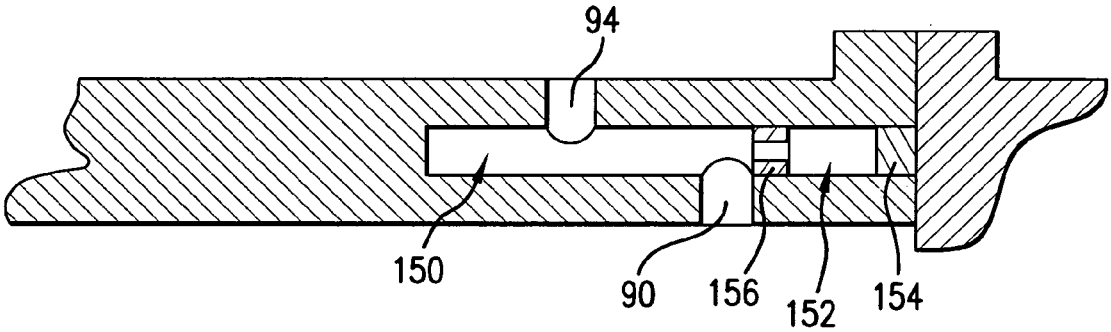
FIG. 4 is a partial longitudinal sectional view of the compressor of FIG. 1 with a third modification according to principles of the invention.

FIG. 4 shows the combination of a side branch resonator 150 and a Helmholtz resonator 152. The exemplary Helmholtz resonator 152 may be tuned by selection of a plug 154 in the bore proximal end to control the Helmholtz resonator volume. The Helmholtz resonator may further be tuned by selecting characteristics of the plug port 156, as previously described. The side branch resonator may be tuned by selecting its length as described.

Figure 5:
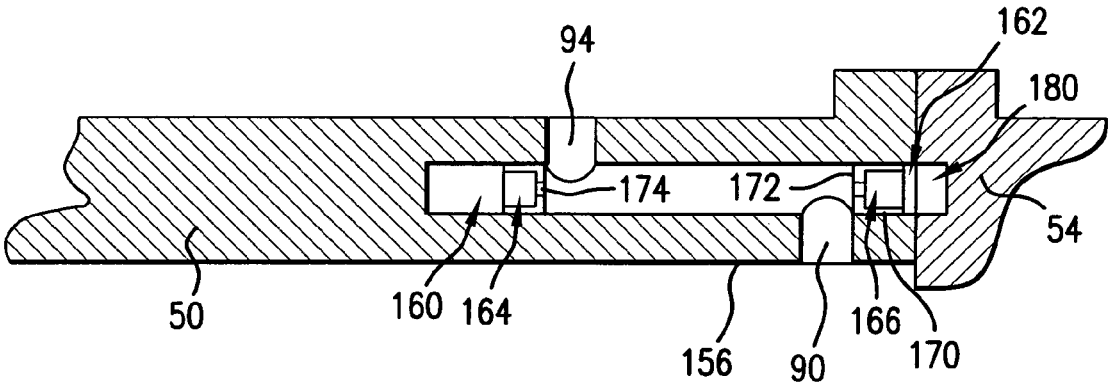
FIG. 5 is a partial longitudinal sectional view of the compressor of FIG. 1 with a fourth modification according to principles of the invention.

FIG. 5 shows Helmholtz resonators 160 and 162 formed with plugs 164 and 166 which may provide a low aperture/port length and/or a low loss of chamber volume. Each plug has a tubular sidewall 170 for engaging the sidewall of the associated volume within the rotor housing 50. Across a proximal end of the sidewall, there extends a web 172 having an aperture/port 174. The length of the sidewall 170 may be chosen for retention and stability. A coaligned bore 180 in the housing 54 increases the chamber volume of the resonator 162. Such a configuration may be particularly useful when the proximal leg 90 is relatively close to the discharge end of the housing 50.

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Implementations may involve compressors having multiple economizer flowpaths (e.g., when a male rotor is enmeshed with two female rotors and each pair has an associated economizer flowpath). The principles may be applied to compressors having working elements other than screw-type rotors (e.g., reciprocating and scroll compressors). Accordingly, other embodiments are within the scope of the following claims.

What is claimed is:

1. A compressor comprising:

a housing;

one or more working elements cooperating with the housing to define a compression path between suction and discharge locations;

an intermediate port along the compression path;

a branch path to the intermediate port; and means for limiting pressure pulsations along the branch path.

2. The compressor of claim 1 wherein the means are means for limiting external sound radiated by the housing due to resonating of discharge pulsation from the one or more working elements.

3. The compressor of claim 1 wherein the branch path includes, within a wall of the housing:

a first leg from the intermediate port;

a second leg distally of the first leg and essentially transverse thereto; and a third leg distally of the second leg and essentially transverse thereto, the means comprising a first blind volume extending from a junction between the second leg and one of the first and third legs.

4. The compressor of claim 3 wherein the means further comprises a second blind volume extending from a junction between the second leg and the other of the first and third legs.

5. The compressor of claim 3 wherein the first blind volume comprises a proximal restriction forming a Helmholtz resonator.

6. The compressor of claim 1 wherein the means is formed within a wall of a casting of the housing.

7. A method for manufacturing the compressor of claim 1 comprising:

casting a precursor of a first portion of the housing;

machining at least one bore in the precursor to accommodate the at least one working element; and machining the precursor to define portions of the branch path, including:

machining a first volume outward from the at least one bore; and machining a second volume from a longitudinal end of the precursor and intersecting the first volume.

8. The method of claim 7 further comprising:

inserting a plug into the second volume; and securing a second housing portion over the longitudinal end across a proximal end of the second volume.

9. The method of claim 8 wherein:

the plug is subflush to the first end and has an aperture defining a port to a Helmholtz resonator.

10. A method for remanufacturing a compressor or reengineering a configuration of the compressor comprising:

providing an initial such compressor or configuration having:

a housing;

a one or more working elements cooperating with the housing to define a compression path between suction and discharge locations;

an intermediate port along the compression path; and a branch path to the intermediate port;

placing a blind volume along the branch path; and selecting at least one geometric parameter of the blind volume to provide a desired control of a pressure pulsation parameter.

11. The method of claim 10 wherein:

the placing locates the blind volume in a wall of the housing.

12. The method of claim 10 wherein the selecting comprises an iterative:

varying of said at least one geometric parameter; and directly or indirectly determining the pressure pulsation parameter.

13. The method of claim 12 wherein:

the determining comprises measuring a sound intensity at a target frequency for pulsation.

14. The method of claim 10 wherein:

the placing includes inserting a plug into a compartment in the housing, the plug having an aperture defining a helmholtz resonator port.

15. The method of claim 10 wherein:

the placing includes inserting a plug into a compartment in the housing to reduce an effective volume of a portion of the compartment.

16. The method of claim 10 wherein:

the placing includes extending a blind terminal portion of a compartment in the housing.

17. A compressor comprising:

a housing;

a one or more working elements cooperating with the housing to define a compression path between suction and discharge locations;

an intermediate port along the compression path;

a branch path to the intermediate port; and a helmholtz resonator in the branch path.

18. The compressor of claim 17 wherein:

the helmholtz resonator is within a wall of a first portion of the housing.

19. The compressor of claim 17 wherein:

the helmholtz resonator is within a wall of a casting of the housing.

20. The compressor of claim 17 wherein the one or more working elements include:

a male-lobed rotor having a first rotational axis; and a female-lobed rotor having a second rotational axis and enmeshed with the first rotor.

* * * * *